United States Patent [19]

Lynch

[11] 4,241,884

[45] Dec. 30, 1980

[54] POWERED DEVICE FOR CONTROLLING THE ROTATION OF A REEL

[76] Inventor: George Lynch, 546 Hull Ct., Burlington, Ontario, Canada

[21] Appl. No.: 22,333

[22] Filed: Mar. 20, 1979

[51] Int. Cl.[3] ..... B65H 49/00

[52] U.S. Cl. ..... 242/54 R; 242/75.43; 242/156.2

[58] Field of Search ..... 242/54 R, 75.42, 75.43, 242/75.53, 78.6, 105, 129.8, 156, 156.2

[56] References Cited

U.S. PATENT DOCUMENTS

| | | | |
|---|---|---|---|
| 2,923,493 | 2/1960 | Fitzgerald et al. | 242/156 |
| 2,946,536 | 7/1960 | Froelich | 242/156 X |
| 3,081,957 | 3/1963 | Van de Bilt | 242/54 R |
| 3,137,452 | 6/1964 | Winders | 242/54 R |
| 3,227,390 | 1/1966 | Wendelken | 242/75.43 |
| 3,545,694 | 12/1970 | Ehrat | 242/75.43 X |
| 3,648,948 | 3/1972 | Level | 242/156 |
| 3,688,999 | 9/1972 | Plattner | 242/75.43 X |

*Primary Examiner*—John M. Jillions
*Attorney, Agent, or Firm*—Ridout & Maybee

[57] ABSTRACT

To control the rotation of wire being fed from a reel, the tension of the wire is sensed by a pivotable arm which, through a valve system, controls operation of a pneumatic cylinder having a reciprocatable piston rod which coacts with a friction clutch. The rod in one position causes the clutch to brake the reel, in response to low tension, and in another position allows the reel to rotate freely, in response to a higher tension, and the rod is reciprocatable to impart accelerating pulses to the reel through the clutch in response to a still higher tension.

9 Claims, 9 Drawing Figures

POWERED DEVICE FOR CONTROLLING THE ROTATION OF A REEL

BACKGROUND OF THE INVENTION

1. Field of the Invention

The present invention relates to a device for controlling the rotation of a reel of filamentary material.

2. Description of the Prior Art

In the processing of wire, or other filamentary material, the wire supply usually is coiled on a reel which is mounted on a wire feeding apparatus, such as a turntable that can rotate to allow the wire to be delivered to the wire processing machine.

Free-running turntables have been used as rotatable mounts for the reels. However, free-running turntables have limitations and disadvantages which have been magnified by a trend to multi-reel processing machines and larger weight coils for increased productivity.

At start-up when a free-running turntable is employed, a sufficient pull must be applied on the wire to be uncoiled in order to overcome the starting torque of the turntable and to establish a constant momentum of the reel. An intolerable load may be imposed on the processing devices, causing damage to equipment and/or loss of material and production time.

Tangling may also be encountered at start-up, especially when heavy coils are employed. A tangle may occur in the reel as the first few outgoing laps of wire are drawn tightly within the coil. The result of the tangle may be malfunction or damage to the processing equipment, or alternatively, the coil may be pulled off the turntable.

Further problems may be encountered during the shut-down of the system when the turntable continues to rotate freely, thus causing the outer laps of wire to loosen and drop about the base of the turntable. Some of the laps of wire must then be gathered and rewound, and the turntable must be prepared for a restart.

In view of the above difficulties associated with free-running turntables, it has been recognized that there is a need for a mechanism whereby the rotation of a reel can be controlled to adjust the tension of the out-going material. Numerous devices have been developed in an attempt to improve the free-running turntable.

For example, U.S. Pat. No. 2,923,493, issued Feb. 2, 1960 to Fitzgerald et al, discloses a device wherein the rotation of the reel is normally free-turning, but the tension in the out-going material can be controlled by the application of a manually adjustable braking mechanism which is forcibly applied by means of pressurized air. The device has an auxiliary feature comprising an air cylinder having a vertically reciprocatable piston rod to engage and disengage the device from the reel.

U.S. Pat. No. 3,081,957, issued Mar. 19, 1963 to Van de Bilt, describes a wire-feeding apparatus wherein a reel having a horizontally mounted axis of rotation can be driven by a pneumatic cylinder which engages the reel via a free-wheel transmission, and a spring-forced brake can be released by a second pneumatic cylinder, both cylinders being actuated by a valve or slide which is adjusted by a device responding to the pull exerted on the outgoing wire. Here the driving and braking forces are applied by two distinctly different and independently operated mechanisms.

U.S. Pat. No. 3,137,452, issued June 16, 1964 to Winders, discloses a mechanism whereby the rotation of a reel is powered by an electric motor operating at constant speed and engaged through a chain, belt or cable to a variable speed pulley connected on a drive shaft in the unit. Braking is achieved through a mechanism, separate from the drive unit as in the Van de Bilt apparatus, incorporating a shoe and drum arrangement actuated by means of a pressurized fluid cylinder.

It is an object of the present invention to provide an improved apparatus for the feeding of filamentary material, for example wire, from a reel wherein the rotation of the reel may be controlled throughout start-up, production and shut-down.

SUMMARY OF THE INVENTION

In accordance with the present invention, a device for controlling the rotation of a reel of filamentary material comprises rotatable reel support means, means for sensing tension of the filamentary material, a reciprocatable element controlled by the tension sensing means to move to a first position in response to low tension and to reciprocate in response to a higher tension, and a clutch operable by the reciprocatable element to brake the reel support means when the reciprocatable element is in the first position, and to accelerate the reel support means when the reciprocatable element is responding to said higher tension. The reciprocatable element may also be movable to another position to allow the reel support means to rotate freely in response to an intermediate tension. Further features of the invention will appear from the claims and from the following description of a preferred embodiment.

Figure 1:
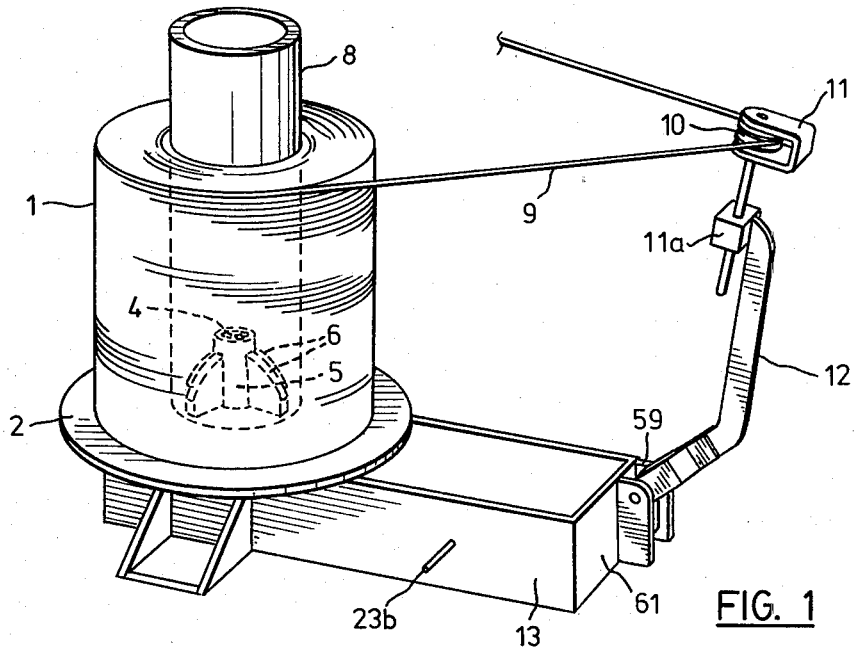
FIG. 1 is a perspective view of a preferred embodiment of the invention showing the general arrangement.

For clarity of illustration, the relative proportions of some of the parts are not consistent in all the views of the drawings.

DESCRIPTION OF THE PREFERRED EMBODIMENT

The preferred embodiment of the invention, as shown in the drawings, is a pneumatically driven device which automatically controls the rotation of a reel of wire in response to the tension of the wire being unwound.

FIG. 1 illustrates the general arrangement of the preferred embodiment with a reel 1 of coiled wire positioned for operation on the device. The reel 1, having its rotational axis vertical, rests on a platter 2 which in turn rests on enlarged portion 3 (FIG. 3) of a vertical reel supporting shaft 4. The platter is centered on the shaft 4 by a cylindrical sleeve 5 fixed to the platter and keyed to the shaft, and the platter carries radial flange members 6 which register with the inner core 8 of the reel. Wire 9 leading from the reel 1 to a processing unit (not shown) is threaded over a pulley 10 and is retained by a keeper 11 adjustably mounted, as at 11*a*, at the upper end of an upwardly extending arm 12 which, as will be described, serves as means for sensing the tension in the wire 9. The major portion of the device is housed within a frame 13. The enlarged portion 3 of the shaft is suitably journalled in the frame 13.

Figure 2:
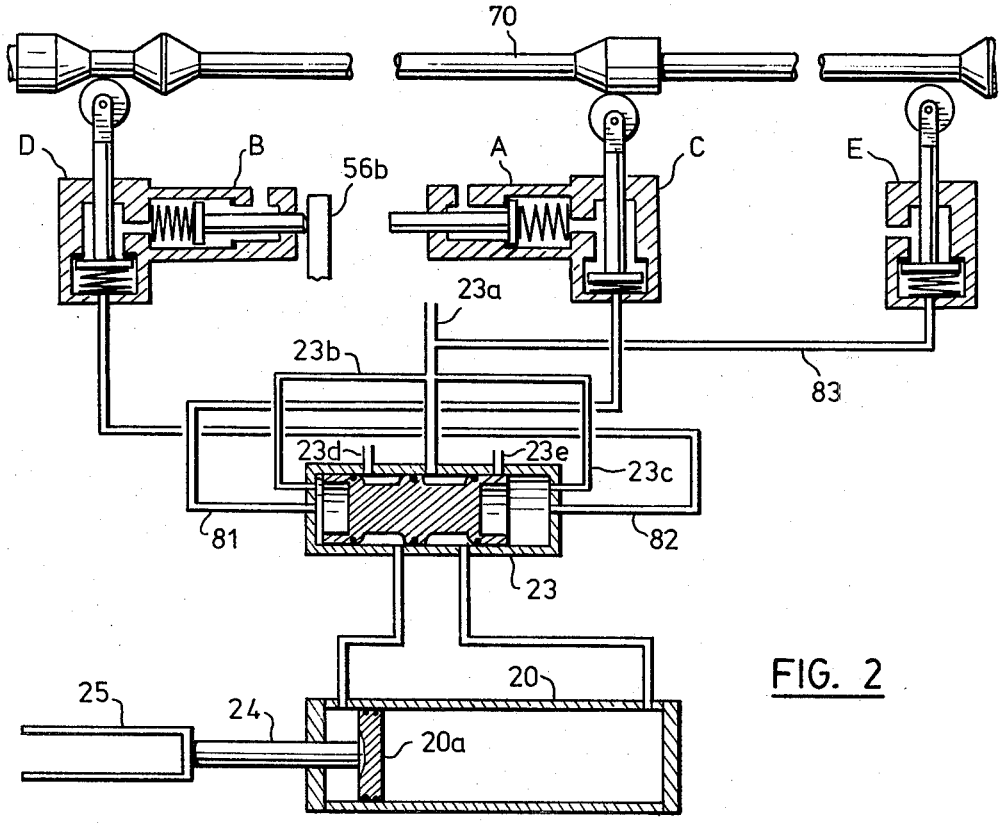
FIG. 2 is a schematic diagram of the pneumatic valve system, the valves being positioned for free wheeling of the reel.
Figure 3:
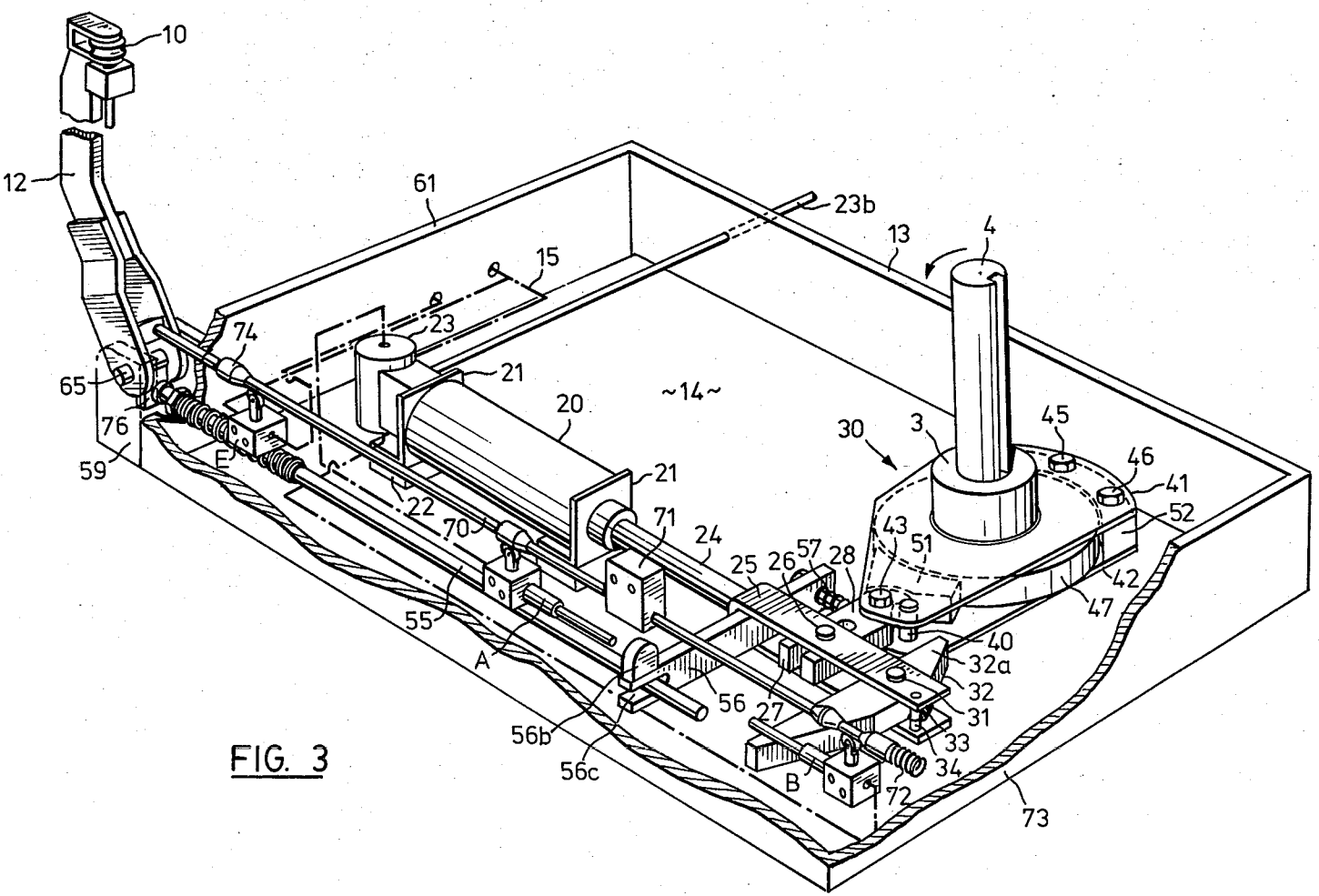
FIG. 3 is a perspective view of components of the device, but viewed from the left hand side of FIG. 1, on a larger scale, with the reel lid and parts of the walls of the frame removed.

FIG. 3 illustrates the arrangement of the major components of the device within the frame 13. The device is powered to brake or accelerate the rotation of the reel 1 by operation of an air cylinder 20 fixed to the base 14 of the frame 13 by means of brackets 21 and pedestals 22. The cylinder 20 has a piston 20*a* (FIG. 2) the movement of which is controlled by a poppet-exhaust-operated four way valve 23 of conventional construction. By means of a valve system described in detail later, air supplied to the cylinder from line 23*a* through valve 23 can cause the reciprocatable piston rod 24 to extend fully, to retract fully, or to reciprocate between two intermediate points. The speed of the piston strokes is controllable by a conventional throttle control 23*b* (FIG. 3) by which the exhaust of air from valve 23 can be throttled. The piston rod has at its end a clevis 25 and the clevis has, midway along its length, a rigid transverse pin and roller 26 which interacts with the slotted end 27 of the camming lever 28 of a friction clutch mechanism generally designated as 30. At the free end of the clevis is a rigid transverse pin 31 about which a pressure lever 32 is pivotably mounted. A spring 33, extending between the lever 32 and a pin 34 on the clevis, urges an end 32*a* of lever 32 to pivot in a direction towards a pin 40 of the clutch mechanism 30.

The clutch 30 includes top and bottom plates 41, 42 which are rigidly connected together by bolts 40, 43, 44, 45, 46. The plates are located above and below a drum portion 47 of the shaft 4 and have sufficient clearance around the shaft portion 3 to permit some lateral shifting of the plates relative to the shaft as clutch shoes 51, 52 engage and disengage the drum 47, as described below. When the shoes 51, 52 are not gripping the drum 47, the plates and shoes are free to swing about the axis of the shaft, the lower end of the shaft 4 being supported by a thrust bearing (not shown). The shoe 52 is fixed to the clutch plates by the bolts 44, 45, 46, and the opposite shoe 51 can be pressed inwardly against the drum 47 by rotation of camming lever 28 in a counterclockwise sense, as viewed in FIG. 4. The lever 28 is pivotable about pin 43, and such counterclockwise rotation of the lever to press the shoe 51 against the drum 47 also draws the shoe 52 into engagement with the drum because of pressure exerted by the lever 28 on pin 43.

Figure 4:
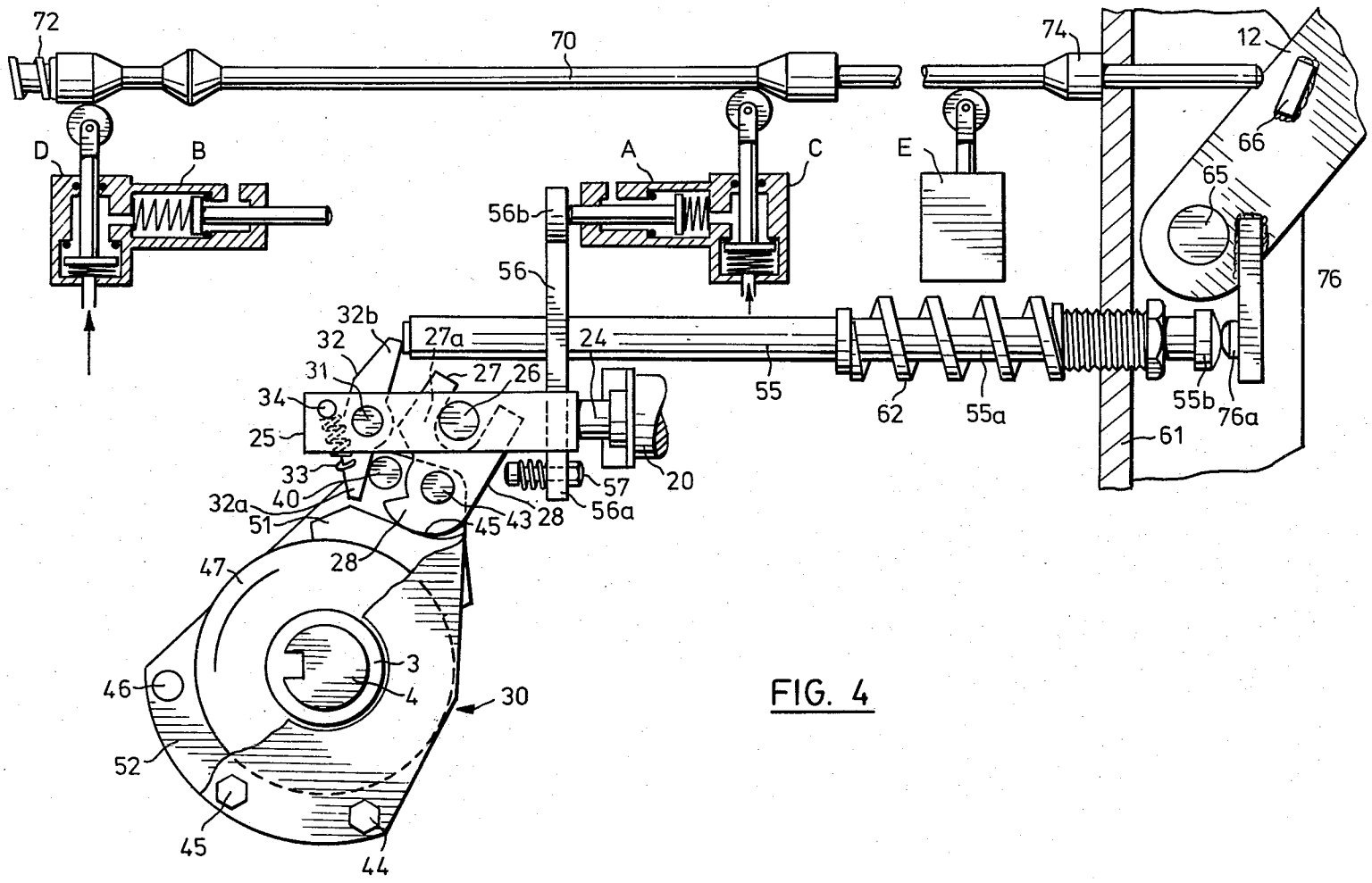
FIG. 4 is a further enlarged top view of parts of the device as they would be seen by a person standing to the north-east of FIG. 3, with the reel braked and at rest.

Thus braking action is achieved when the piston rod 24 is moved to the braking position of FIG. 4. The end 32*b* of pressure lever 32 comes into engagement with the end of a brake adjustment rod 55. This forces the opposite end 32*a* of the lever against the pin 40, and an arm 27*a* of camming lever 28 is pressed against roller 26 causing the camming lever 28 to rotate counterclockwise about pin 43 and force the brake shoes 51, 52 against the drum 47.

Figure 5:
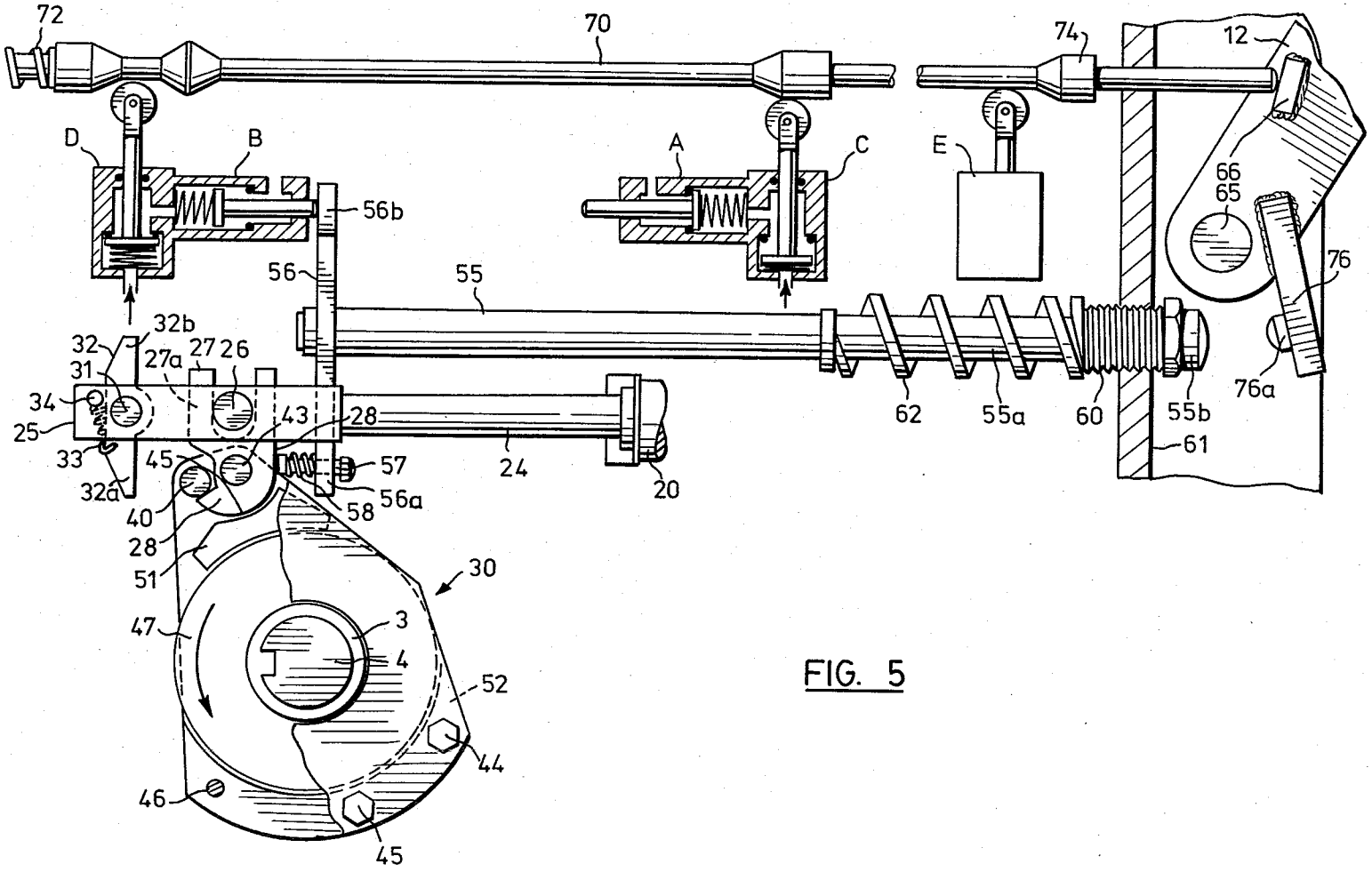
FIG. 5 is a top view similar to FIG. 4, with the reel free wheeling (as for FIG. 2)

The brake is released when the rod 24 is extended to the free wheeling position of FIG. 5. Here the pressure lever 32 is out of contact with the brake adjustment rod 55, but the piston rod 24 has fixed to it a bracket 56 which, at its end 56*a* adjacent the clutch 30, carries a longitudinally slidable pressure pin 57 that is urged in the direction of the camming lever 28 by a spring 58. This yieldably urged pin 57 presses the camming lever 28 against the clutch pin 40, out of engagement with the brake shoe 51 so that the shaft 4 can rotate freely. The bracket 56 has at its opposite end a lug 56*b* which opens pilot valves A and B at opposite ends of the piston stroke, the valves A and B (as well as a valve E) being mounted on a side wall 59 of the frame 13. This lugged end of bracket 56 is forked (FIG. 3) at 56*c* to embrace loosely the longitudinal brake adjustment rod 55.

Figure 6:
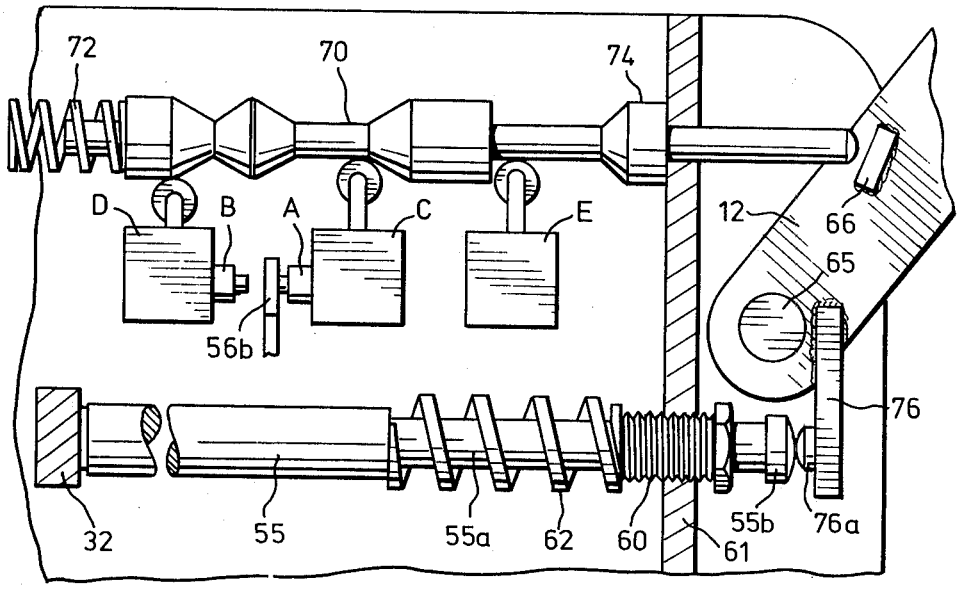
FIGS. 6 to 9 are schematic and broken away side views, also as they would be seen by a person standing to the north-east of FIG. 3, illustrating various operative conditions as the control arm at the right is rotated counterclockwise.

The brake adjustment rod 55 is longitudinally slidable in bearings (not shown) mounted on the side wall 59 of the frame. As best seen in FIG. 6, the rod 55 has, at its end remote from the pressure lever 32, a bolt extension 55*a*. Bolt 55*a* passes slidably through a sleeve 60 that is threaded into the end wall 61 of the frame 13, the bolt 55*a* being headed at 55*b* outside the frame. A spring 62, in compression between the sleeve 60 and the rod 55, urges the rod in the direction of the pressure lever 32. The compression in the spring 62 can be adjusted by screwing the bolt 55*a* further into or out of the rod, thereby providing a simple means of adjusting the braking force that is applied to the pressure lever 32 when it engages the adjustment rod 55. The longitudinal position of the rod 55, relative to the end 32*b* of the lever, can be adjusted by screwing the sleeve 60 relative to the end wall 61.

The sensing arm 12 is pivotally mounted at 65 on the side wall 59 of the frame 13. Above the pivot point 65 the arm has a transverse post 66 (FIG. 6) mounted in line with the end of a longitudinal cam shaft 70. The cam shaft passes through the end wall 61 and is longitudinally slidable in bearings such as 71 (FIG. 3) mounted on the side wall 59. At its opposite end the shaft 70 is spring pressed by a spring 72 which bears against end wall 73 of the frame, so that an abutment 74 on the shaft is normally held against the frame end wall 61. Counterclockwise rotation of the arm 12, as shown in FIGS. 6–9 causes post 66 to move the cam shaft 70 to the left. Linear motion of the cam shaft to the left causes the faces of cams on shaft 70 to interact with rollers to open valves C, D, E, mounted on the side wall 59, in the sequence shown in FIGS. 6–9.

Below its pivot point 65 the sensing arm 12 carries a striker plate 76 having an abutment 76*a* in line with the end 55*b* of the brake adjustment rod. With the sensing arm resting in its furthest clockwise position (that shown in FIG. 6), i.e., with no tension in the wire 9, the weight of arm 12 is applied via the abutment 76*a* to the end of brake adjustment rod 55, thereby applying additional braking force to pressure lever 32.

The exhaust valves A, B and the control valves C, D form a valve system which establishes the operating mode of the cylinder 20 (i.e., retraction, extension or reciprocation of piston rod 24) by control of air flow to and from the poppet valve 23. Valve 23 is a conventional two position valve which directs the air to one end of the cylinder or the other depending on whether the valve's outlet line 81 or its other outlet line 82 is connected to exhaust.

The air lines interconnecting the valves are schematically illustrated in FIG. 2. Both ends of control valve 23 are supplied with compressed air from line 23*a* through bleeder lines 23*b*, 23*c*. Valve C is connected into the outlet line 81 and permits exhaust of air from the left hand end of valve 23 when valves C and A are open. Valve D is connected into the other outlet line 82 and permits exhaust of air from the right hand end of valve 23 when valves D and B are open. When both valves A and C are open and one of the valves B and D is closed, the control valve 23 directs compressed air from line 23*a* into the blind (right) end of the cylinder 20 while the opposite end of the cylinder 20 is allowed to exhaust back through the poppet valve to exhaust port 23*d*. Thus, the piston rod 24 extends to the left. When both valves B and D are open and one of valves A and C is closed, the air flow in the cylinder is reversed and the piston rod 24 retracts, air from the right hand end of cylinder 20 exhausting through port 23*e*.

FIGS. 6 to 9 show different valve conditions that are determined by different positions of the sensing arm 12. At start-up, with little or no tension in the wire 9, the arm 12 is in the position of FIG. 6. With the condition of FIG. 6, valve C is closed. Therefore air cannot exhaust through A, and the piston rod remains retracted as in FIG. 4 with full braking applied to the reel.

Figure 7:
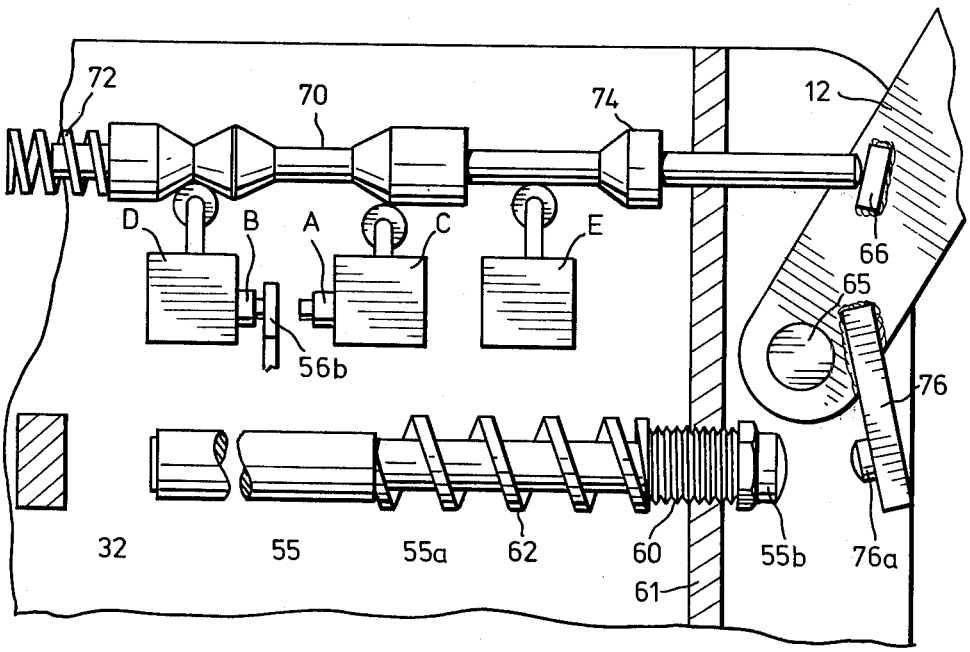
Figure 8:
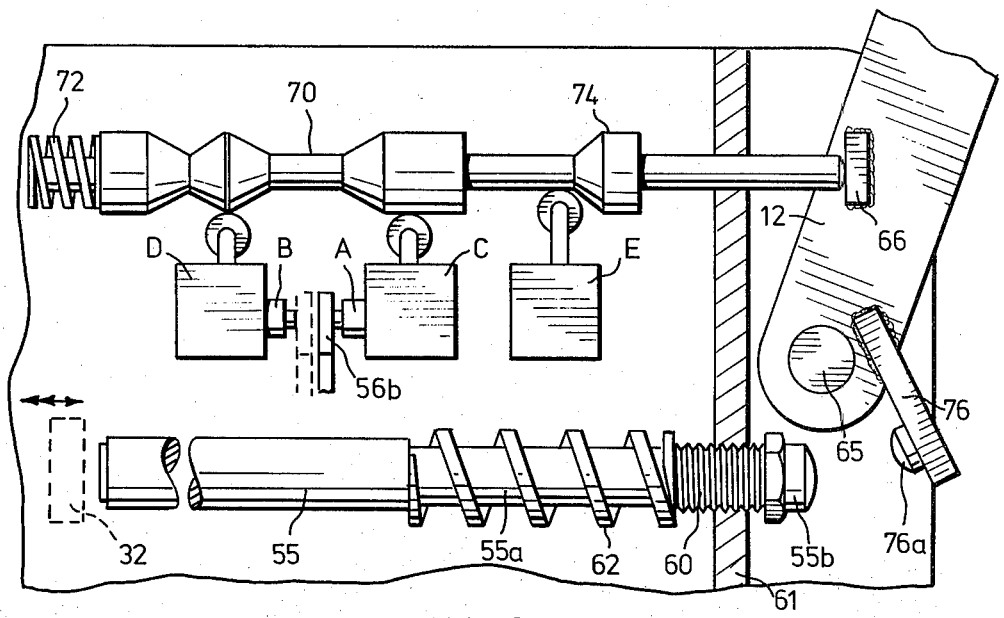
Figure 9:
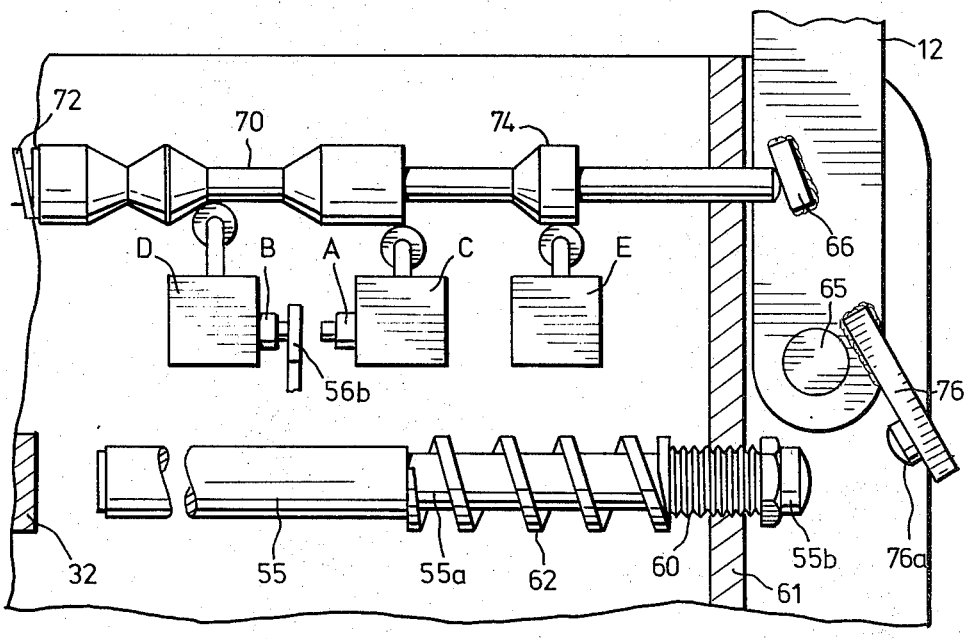

As tension of the wire 9 increases the sensing arm 12 pivots counterclockwise, pushing the cam shaft 70 to the left. This causes valve D to close and valve C to open. Exhaust can occur through valves A and C causing the piston rod 24 to extend and thus to move lug 56*b* out of engagement with valve A (closing it) and into engagement with valve B (opening it) so that the free wheeling condition of FIGS. 7, 5 and 2 is achieved.

If wire tension increases, the reel needs to be given forward impetus to relieve the tension. The further wire tension pulls arm 12 further counterclockwise, moving the cam shaft 70 further to the left so that both valves C and D are open, exhaust through B and D can occur, and the piston rod retracts, closing B and opening A, whereby the piston rod extends again, and whereby there is continued reciprocation of the piston rod 24 while the increased tension condition of FIG. 8 prevails. On each retraction stroke the end 32*a* of lever 32 contacts the pin 40, closing the clutch 30 under light pressure from spring 33, but the force is insufficient to create any braking effect on the drum 47, the force merely being sufficient to preset the clutch for the next extension stroke of the piston. On each extension stroke, with the clutch so preset, the clutch 30 grips drum 37 without delay or bounce, the lever 28 being rotated clockwise around pivot 43 to move the clutch mechanism to the closed condition of FIG. 4, so that during the initial portion of the extension stroke, with the shoes 51, 52 gripping the shaft drum 47, the shaft is given a forward impulse, to relieve the tension on the wire. If the tension is relieved, the device reverts to the free wheeling condition of FIGS. 5 and 7. If, however, the wire tension continues to increase, the arm 12 is pulled to the extreme counterclockwise position of FIG. 9. Valve D closes, so that piston rod reciprocation ends with the rod 24 in the extended (free wheeling) position. Valve E opens, thereby opening an air line 83 (FIG. 2) to a shut-off or warning device (not shown) to signal that an excessive wire tension has been reached.

It is therefore seen that the device automatically applies a braking force to the shaft 4 when wire tension is small, applies acceleration forces to the shaft when tension is higher, and allows free rotation of the shaft at intermediate tensions. The drive mode, with acceleration forces given to the shaft, may be maintained with the arm 12 anywhere from about, for example, 10° to 15° from the vertical so that wire tension is maintained within a range corresponding to this range of control arm inclinations. During the drive mode, the piston rod reciprocates between positions short of its fully extended and fully retracted positions, the lengths of the reciprocatory strokes being determined by the positions of the valve stems of valves A and B.

During shut-down the reel 1 must be allowed to slow to a stop without undue loss of tension of the wire 9. As tension in the wire diminishes the arm 12 swings clockwise, thus restoring the conditions which cause the piston rod to retract and to apply braking force.

While the invention has been described with particular reference to the preferred embodiment illustrated, other embodiments within the scope of the following claims will occur to those skilled in the art.

I claim:

1. A device for controlling the rotation of a reel to control the tension on a filamentary material being unwound therefrom, comprising:

(a) a rotatable reel support means, (b) means for sensing tension on the filamentary material, (c) valve means responsive to said tension sensing means, (d) a powered device including a reciprocatable element controlled by said valve means in accordance with the tension on said filamentary material to move to a first position in response to low tension, to reciprocate in response to high tension, and to move to a second position in response to an intermediate tension, and (e) a clutch operable by the reciprocatable element, the clutch being engageable with the rotatable reel support means in response to movement of the reciprocatable element to said first position, thereby to brake said reel support means, the clutch being disengageable from the reel support means in response to movement of the reciprocatable element to said second position, thereby to allow free rotation of the reel support means, and the clutch being intermittently engageable with the reel support means in response to reciprocation of the reciprocatable element thereby to apply accelerating impulses to the reel support means.

2. A device as claimed in claim 1, wherein the powered device is a double acting air cylinder, said valve means comprising a two-position control valve operatively connected to the cylinder, a pilot valve system operatively connected to the control valve, and a movable element engageable with said tension sensing means operable thereby to actuate the pilot valve system.

3. A device as claimed in claim 1, including means operable by the tension sensing means to signal excessive tension on the filamentary material.

4. A device as claimed in claim 1 wherein the clutch has shoes movable by the reciprocatable element to engage the reel support means.

5. A device as claimed in claim 4 wherein the clutch includes a camming lever pivotable in one sense relative to the shoes to move the shoes to engage the reel support means and pivotable in the opposite sense to release the shoes.

6. A device as claimed in claim 5, including brake pressure adjusting means for varying the pressure applied by the camming lever on the shoes.

7. A device as claimed in claim 6, wherein the tension sensing means applies braking pressure to the adjusting means in the absence of tension on the filamentary material.

8. A device as claimed in claim 1, wherein the reciprocatable element applies the accelerating impulses by engaging the clutch with the reel support means at the beginning of each reciprocatory movement in one direction.

9. A device as claimed in claim 1 in combination with a reel of wire on said support means.

* * * * *